US007121232B1

(12) United States Patent
Janhunen

(10) Patent No.: US 7,121,232 B1
(45) Date of Patent: Oct. 17, 2006

(54) METHOD IN AN INTERNAL COMBUSTION ENGINE AND AN INTERNAL COMBUSTION ENGINE

(76) Inventor: Timo Tapani Janhunen, Leankuja 4, Monninkyla (FI) FIN-07230

( * ) Notice: Subject to any disclaimer, the term of this patent is extended or adjusted under 35 U.S.C. 154(b) by 244 days.

(21) Appl. No.: 10/111,682

(22) PCT Filed: Oct. 10, 2000

(86) PCT No.: PCT/FI00/00870

§ 371 (c)(1),
(2), (4) Date: Apr. 25, 2002

(87) PCT Pub. No.: WO01/42634

PCT Pub. Date: Jun. 14, 2001

(30) Foreign Application Priority Data

Oct. 25, 1999 (FI) ..... 19992301

(51) Int. Cl.
*F02B 41/00* (2006.01)

(52) U.S. Cl. ..... 123/26; 123/432

(58) Field of Classification Search ..... 123/46 A, 123/559.1, 65 VD, 53.4, 53.6, 55.7, 66, 197.3, 123/26, 432, 305
See application file for complete search history.

(56) References Cited

U.S. PATENT DOCUMENTS 2,012,229 A * 8/1935 Gehres et al. ..... 123/69 V
2,183,116 A * 12/1939 Coates ..... 123/71 V
2,212,167 A * 8/1940 Peterson ..... 123/69 V
2,693,076 A * 11/1954 Francis ..... 123/46 A
2,769,435 A * 11/1956 Cass ..... 123/69 V
4,205,528 A * 6/1980 Grow ..... 123/46 A
4,732,117 A * 3/1988 Tanahashi et al. ..... 123/65 VD
4,860,699 A * 8/1989 Rocklein ..... 123/26
4,998,525 A * 3/1991 Eftink ..... 123/559.1
5,140,958 A * 8/1992 Kobayashi et al. .... 123/65 VD
5,343,839 A * 9/1994 Baika et al. ..... 123/65 VD
5,682,844 A * 11/1997 Wittner ..... 123/197.3
6,234,126 B1 * 5/2001 Kaye ..... 123/65 VD

* cited by examiner

*Primary Examiner*—Henry C. Yuen
*Assistant Examiner*—Jason Benton
(74) *Attorney, Agent, or Firm*—Skinner and Associates

(57) ABSTRACT

An internal combustion engine, Z-engine. The compression part and the working part are separated. New gas is transported to the upper side of the piston. Below there is a small chamber corner. When the piston comes nearer the upper hollow part, the combustion gases go out from the cylinder through exhaust-valves. After the changing of the gas, before filling the upper chamber, there is a secondary compression, the firing of the mix, or fire. In advance of the compression can be other than the volume of the working pistons together. The side effect of the piston can be taken away by means of a double cam mechanism.

24 Claims, 7 Drawing Sheets

Figure 1A:
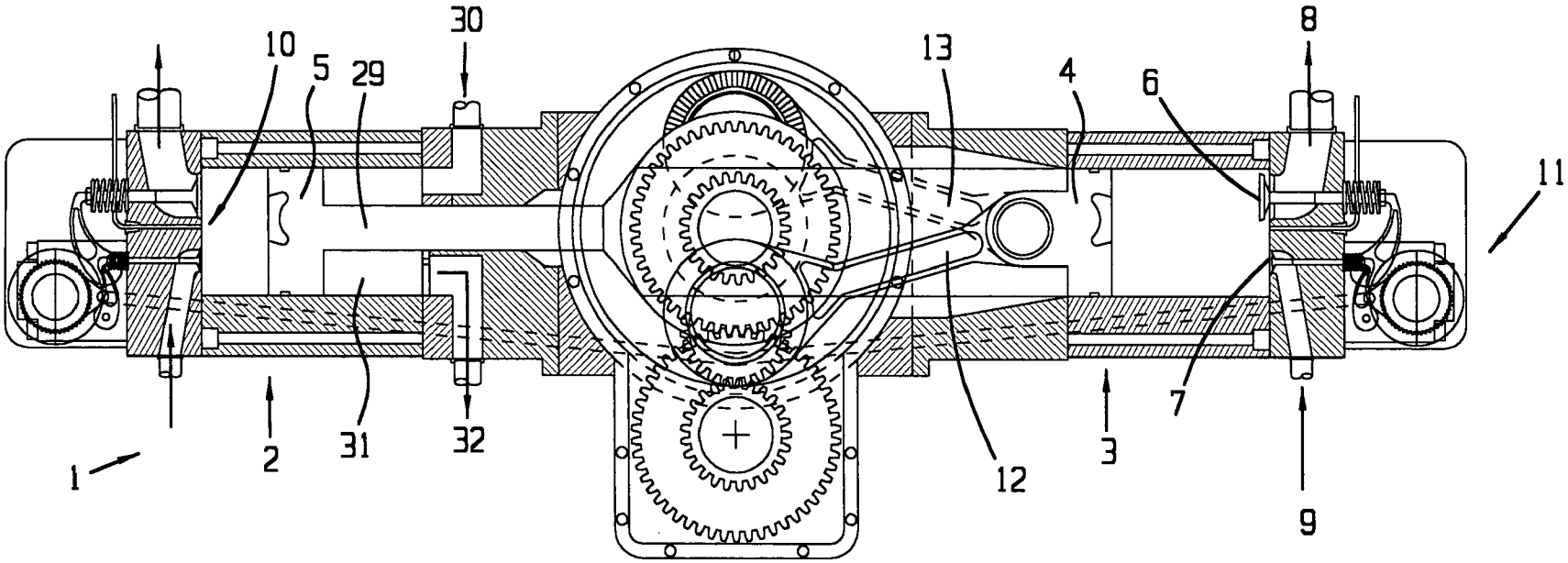

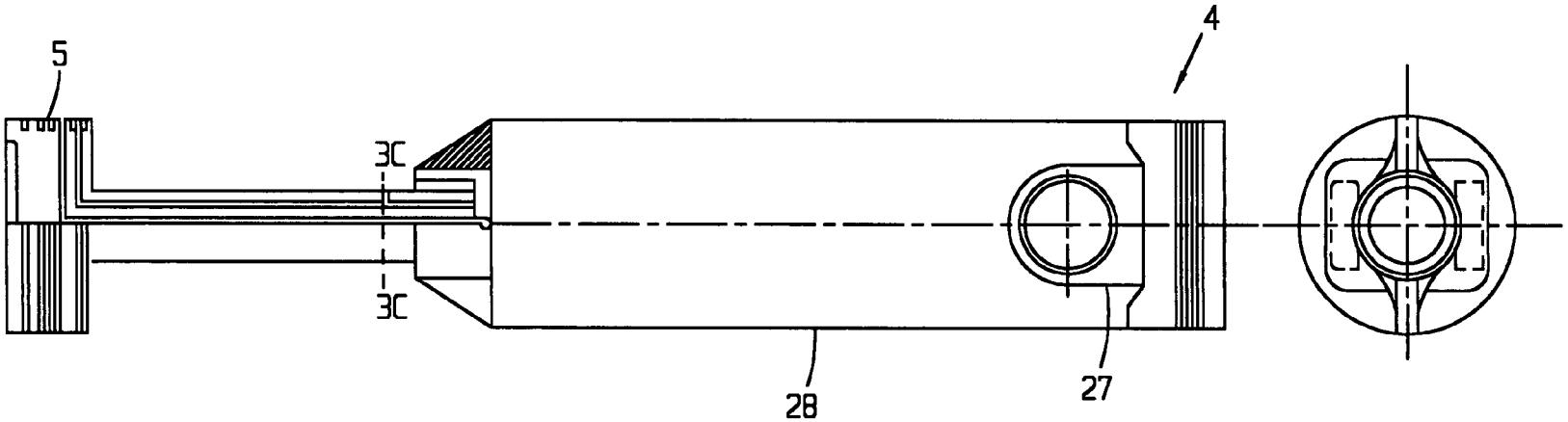
FIG. 3A
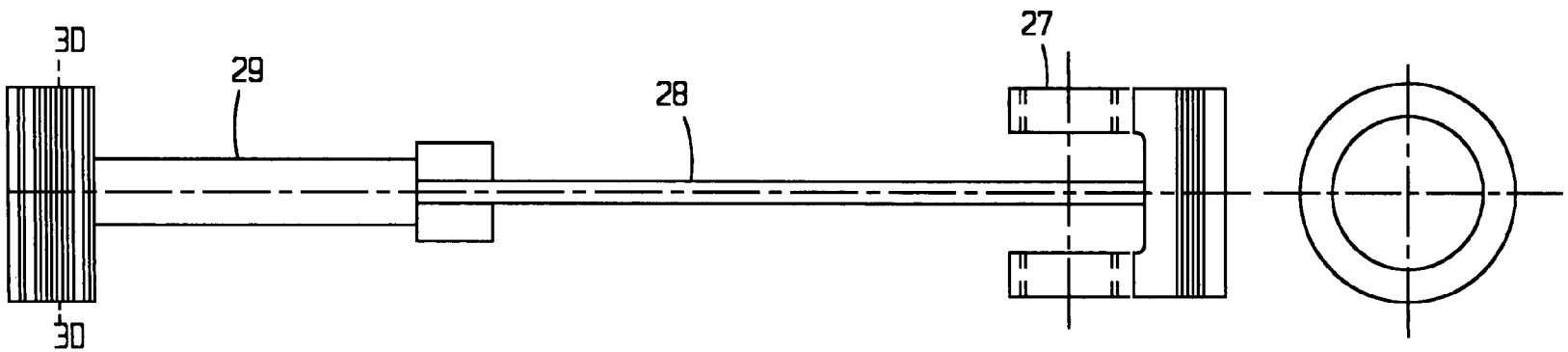
FIG. 3B
FIG. 3C
FIG. 3D

METHOD IN AN INTERNAL COMBUSTION ENGINE AND AN INTERNAL COMBUSTION ENGINE

The present invention relates to a method in an internal combustion engine and also to an internal combustion engine.

The internal combustion engines may be roughly divided into the categories of diesel engines, in which the ignition of the mixture of fuel and air is effected by the aid of pressure and otto engines in which the ignition of the mixture is effected by the aid of a spark plug.

When divided in a different way, the engines may be divided into groups based on their working principle; four-stroke engines and two-stroke engines.

All types of engines have their advantages and disadvantages. Two-stroke engines produce power in each rotation of the crankshaft, but the control of the scavenging of the exhaust gases from the cylinder has been very difficult. The main disadvantage of the four-stroke engines has been the fact that the work cycle is effected only at every second rotation of the crankshaft. Controlling of the fuel mixture and exhaust gases is in the four-stroke engines much easier than in two-stroke engines. In four-stroke engines the size of the engine tends to increase and the mechanical losses are higher than in two-stroke engines. The increase of the compression ration in a diesel engine improves the efficiency, but rises at the same time the compression temperature and thus the temperature during the combustion. This means that the thermal losses and the amount of the nitrogen oxides, NOx increase. In general, the side force of the piston is one of the biggest sources of the friction losses in the engine and it should be removed.

According to the state of the art numerous attempts to avoid the disadvantages of the known engine construction have been made. Some of those are described in the following.

U.S. Pat. No. 5,285,752 deals a very complicated engine construction having three pistons aligned in a cylinder set, two of these pistons are scavenging piston and the work piston in located in between the same. Power output is effected by the aid of one of the scavenging pistons. The latter has two connecting rods which have been connected to two interconnected gear wheels to rotate them. The angle of the connecting rods become quite wide.

The engine has a compressor part in two parts and its compressor pressure (scavenging pressure) is low, perhaps 1–2 bar. The gas exchange occurs at the bottom dead centre of the piston and occurs through grooves in the piston shaft. The shaft of the piston must be tightened against the high combustion pressure and temperature.

In the two-stroke otto engine described in the publication DE 2703316 there is a separate compressor piston in addition to a work piston. The compressor piston moves on the average 10–15 crank shaft angle in advance compared with the work piston or about 90 crank shaft angle after it. It has a heat insulation in the upper part of the cylinder, at the top of the piston and in the gas exchange duct where the ignition of the fuel/air mixture happens. The construction includes at least one swirl chamber.

In U.S. Pat. No. 5,505,172 the efficiency of the two-stroke otto engine has been tried to be improved by using two separate gas mixtures, whereby the rest of the exhaust gases in the cylinder and the new air/fuel mixture are compressed and ignited in the cylinder, but the new air/fuel mixture is sprayed to a restricted chamber in the upper part of the cylinder.

EP 0779421 deals with the removing of the side force of the piston by means of crank shafts, synchronized with bevel gears. The connecting rod has been divided in two in the lower part of the same. The upper part makes linear movements and the outer ends of the lower parts have been connected to the crankshafts.

In the engine according to U.S. Pat. No. 5,857,436 there is a compressor and work piston pair, moving synchronous and a connecting duct, which connects the same and is equipped with a heat exchanger in order to heat the compressed air more. The volume of the connecting duct is equal to the delivery of one stroke of the compressor piston. The gas exchange occurs at the top of the dead centre of the piston at zero volume.

U.S. Pat. No. 3,880,126 deals with an engine having a spark ignition and consisting of cylinder head pairs, equipped with a normal crank mechanism. The cylinder head pairs have in their common cylinder head a connecting duct between the compressor cylinder and the work cylinder. The exhaust valve closes early "enough" in order that a relatively big volume of the exhaust gases remains in the work cylinder, according to the text 50% or even more. Behind this the aim is to keep the gases in the cylinder and the surfaces of the cylinder and the piston as hot as possible, in order to have the HC-emission to remain low. The gas exchange pressure is according to the explanation low, perhaps 1–2 bar. The gas exchange angle is wide, over 90□ and the gas exchange starts quite early, about 90□ after the bottom dead centre, according to the explanation.

The secondary compression ratio has been limited to be quite low, as the engine runs with gasoline or similar fuel. The engine is equipped with spark ignition. As large amount of hot exhaust gas remains in the cylinder, the temperature is remarkably raised, causing the danger of knock. The connecting duct, having quite a large volume, between the compressor cylinder and the work cylinder limits also the compression ratio. The delivery ratio of the compressor piston is quite poor, because of the construction. It is not allowed that the exhaust gases, which remain in the cylinder and the fresh mixture blend much with each others, otherwise there is a problem with the ignition.

The invention will be described in more detail in the following with reference to the drawings describing one example of an engine according to the present invention.

Figure 1B:
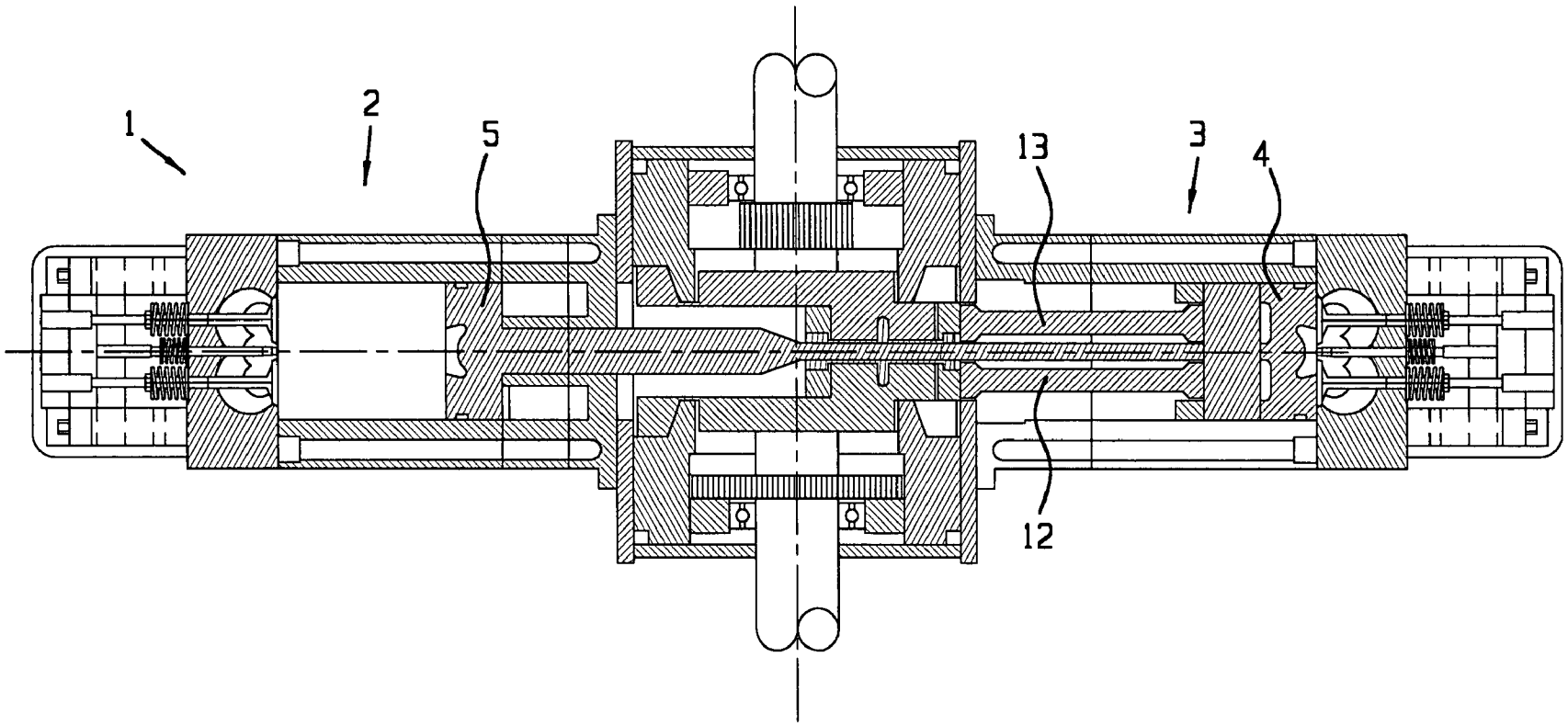

FIG. 1*a* describes an engine construction according to the present invention as a longitudinal section;

FIG. 1*b* shows the same construction now seen in the direction turned 90 degrees from the one of FIG. 1*a;*

Figure 2A:
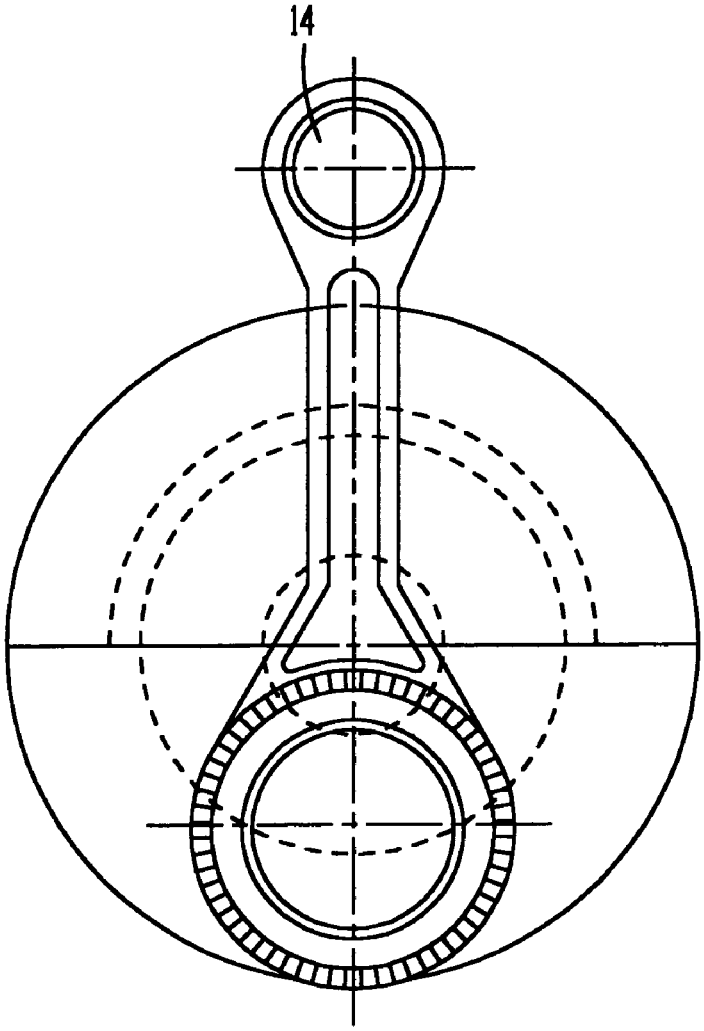
Figure 2C:
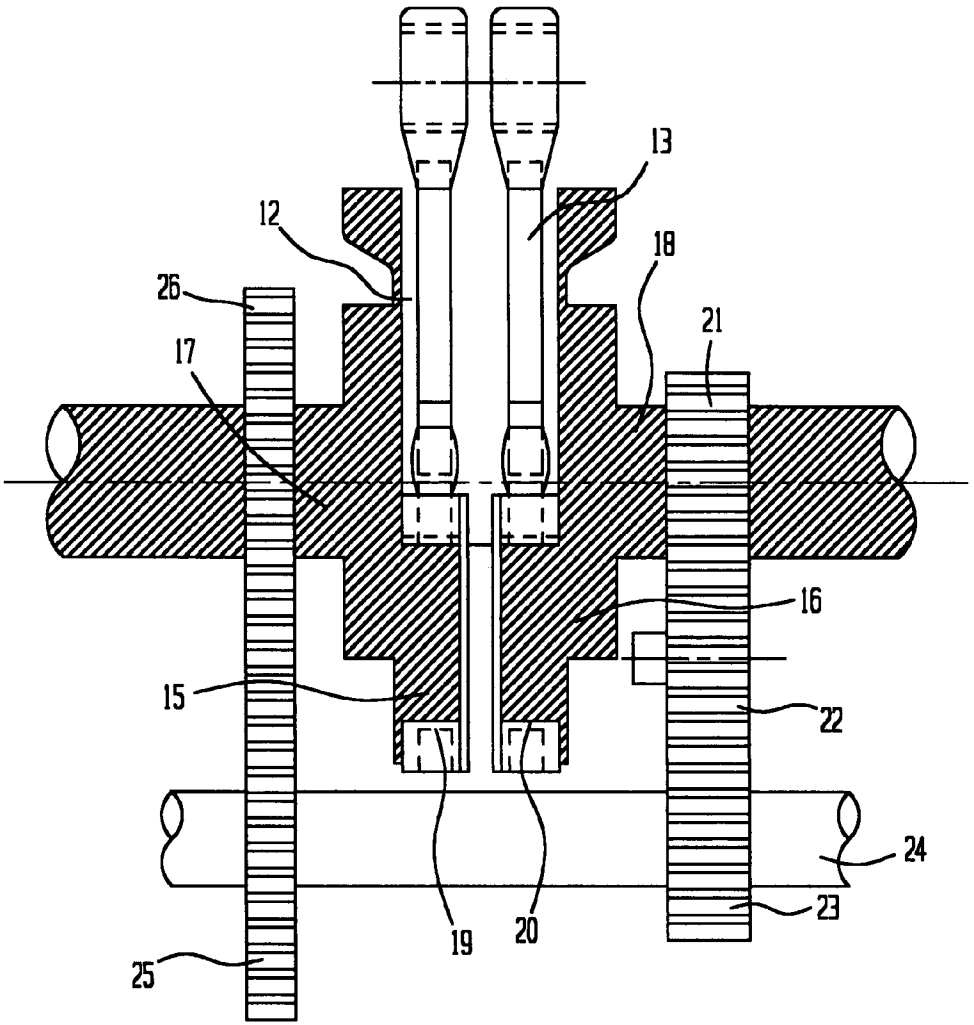
Figure 2B:
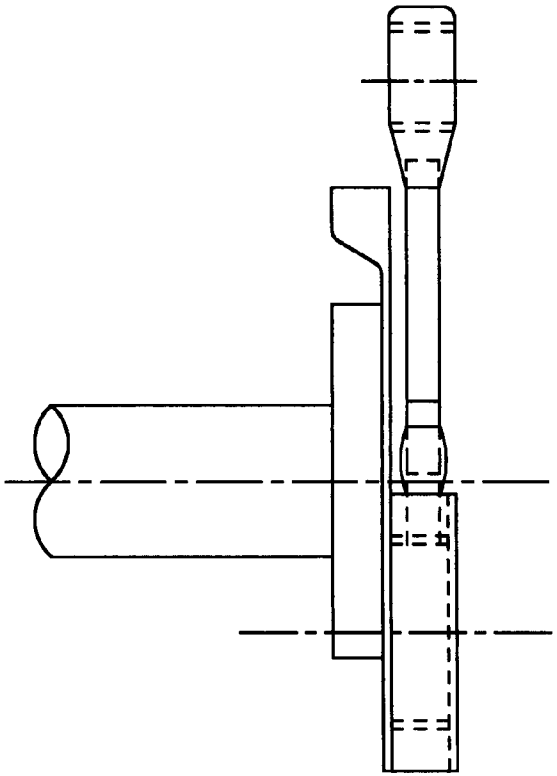

FIG. 2*a* is a partly view of that shown in FIG. 1*a* now showing the connecting rod and partial crankshaft only;

FIG. 2*b* is an illustration of FIG. 2*a* now turned 90 degrees from that shown in FIG. 2*a;*

FIG. 2*c* is a complete exemplary illustration of the connecting rods and the crankshaft halves, but also the gears connecting the crankshaft halves;

FIGS. 3*a*, 3*b*, 3*c*, and 3*d* show the piston system of the engine according to the invention seen in two directions and in two sections 3C—3C and 3D—3D;

FIGS. 4*a*–4*e* show one embodiment of the working principle according to the present invention; and FIGS. 5*a*–5*e* show an alternative embodiment of the working principle according to the invention including the internal exhaust gas re-circulation.

First of all it is described the general construction of the engine according to the invention. Reference is made especially to FIGS. 1 to 3. After that it is described the working principle according to the invention and then reference is made to FIGS. 4*a*–4*e* and FIGS. 5*a*–5*e* when an alternative working principle is described.

In the preferred embodiment of the invention the engine has e.g. the overall construction shown in FIGS. 1*a* and 1*b*. Even though an engine construction is clear and self-evident for persons having average skills in the field of engines and motors, a detailed description is given for the sake of clarity. So the engine 1 consists of two cylinders 2 and 3 in which a piston having two piston heads 4 and 5 is reciprocating.

As clearly shown, FIG. 1*a* and FIG. 1*b* have been shown in sections differing from each other by 90 degrees. Also another difference exists between these figures; in FIG. 1*a* the piston is moving toward its dead centre in either direction, but in FIG. 1*b* the piston head 4 is in its uppermost position and accordingly piston head 5 is in its lowest position.

The construction of the piston is described in more detail in FIGS. 3*a* and 3*b*.

In a conventional manner the engine 1 has an exhaust valve 6 or valves and an inlet valve 7 or valves and, of course exhaust channel 8 and inlet channel 9. The engine also has a fuel injection nozzle 10. The mechanism for operating the valves has been here referred as number 11 and its construction may be of any conventional type including a camshaft or several camshafts.

One of the piston heads, the one designated with reference number 4, is connected, by the aid of two connecting rods 12 and 13 with a crankshaft construction which is described in more detail in FIGS. 2*a* to 2*c* in addition to FIGS. 1*a* and 1*b*. In a conventional manner the connecting rods 12 and 13 have been fastened with bearings to the piston pin at their upper ends and in their lower end the connection has been made to the crankshaft having suitable parts 15 and 16 protruding from the two crankshaft halves 17, 18. A bearing 19, 20 is equipped to make this joint.

The halves of the crankshaft are rotating in opposite directions. In this way the side forces of the piston are completely cancelled and the power that has been consumed for these forces before can be used now for producing output power from the engine. Also the need for replacing parts as a result of the wearing of the parts is remarkably decreased.

As the direction of rotation is opposite on the halves 17 and 18 of the crankshaft, the direction of one of the halves is changed. This can be done by the gears and by an auxiliary shaft. So the crankshaft half 18 has a rigid spur gear 21 around it. This gear is engaged to an intermediate gear 22, which in turn is engaged with a further spur gear 24. The gear 23 in mounted on an accessory shaft 24, on which also a spur gear 25 which engages a spur gear 26 mounted on the other half 17 of the crankshaft, is mounted. This means that, even though the halves of the crankshaft are rotating in opposite directions, the power from these halves can be taken out from one of the crankshaft halves or from the shaft 24. The end of the other half can be used for other purposes.

The above construction is very steady and achieves a construction in which the friction and wearing are at their minimum. This new type of crank mechanism enables at the same time the balancing of the mass forces of first order.

FIGS. 3*a* and 3*b* show the piston of the engine in two directions turned from each other by 90 degrees. It can be readily seen that the piston is only one piston with two heads. In the conventional manner this would be two separate pistons. The piston heads 4 and 5 have piston rings to seal the piston against the cylinder surface. The connecting rods are to be fitted to one of the piston heads 4 in a conventional manner by the aid of a piston pin coming through protrusions 27 in the piston head. The piston rod begins from the head 4 and is, in this embodiment, in the form of a flat plate-like part 28. Anyhow, the form is not critical and may thus be e.g. circular in cross-section. As can be seen in FIG. 1, the piston rod will reciprocate and move between the crankshaft halves 17 and 18. The movement is linear.

The piston rod 29 starting from the piston head 5 is preferably of circular cross-section, which is a benefit in the case the piston head is used also as a piston of a compressor as described later. Sealing of a circular rod is much easier than a rod of other cross-section. The channels seen in the rods and piston heads are for transporting lubricating oil.

Now the extraordinary and revolutionary new principle of engine is described in two embodiments with reference to FIGS. 4*a* to 4*e* and respectively FIGS. 5*a* to 5*e*.

The present engine according to the invention, described in FIGS. 1 to 5 is based on the combination of two- and four-stroke cycles and on an isolated compressor part and on the leading of the new mixture to the cylinder, close at the top dead centre, at every rotation of the crankshaft, during a small crank angle. When the gas exchange occurs according to the enclosed FIGS. 4–5, work shall be gained at every rotation of the crankshaft. This increases the mechanical efficiency of the machine.

First, reference is made to FIGS. 4*a* to 4*e*. For clarity, reference numerals of the main parts have been added only to FIG. 4*a*. The combination of camshaft, valve followers etc. have been designated with only one reference numeral 11.

Figure 4C:
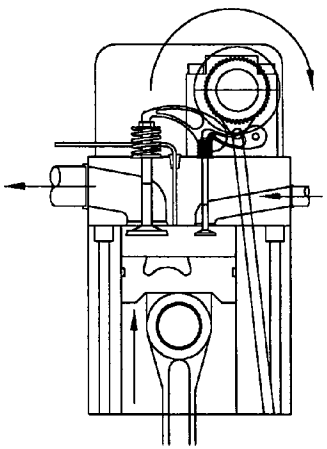
Figure 4B:
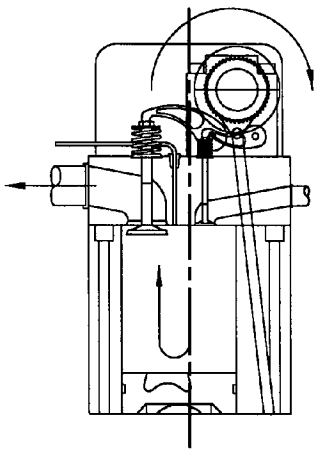
Figure 4A:
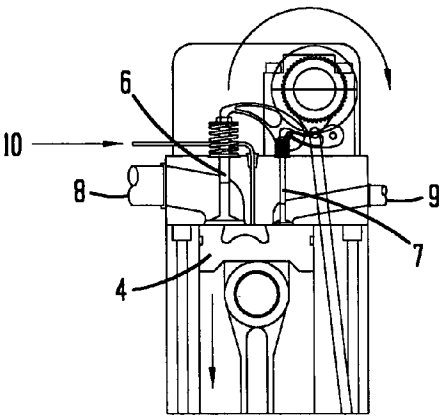

FIG. 4*a* shows the work phase of the engine. Fuel has been injected through nozzle 10, the compressed fuel/air mixture ignites or is ignited and expansion pushes the piston 4 down and the power will be taken out from the engine as described before. In the opposite cylinder the piston is, as is evident, in its lowest position. Both the exhaust valve 6 and the scavenging valve 7 are closed. The piston 4 moves to its lowest position and starts to return up. The exhaust valve 6 is opened so that the exhaust gases may escape from the cylinder by the aid of the piston returning up. This is shown in FIG. 4*b*.

In FIG. 4*c* the piston has returned quite high and the scavenging valve 7 is opened and pressurized air is directed from a suitable pressurized air reservoir to the cylinder causing gas exchange happen in the upper part of the cylinder. In other words the pressurized air pushes exhaust gases out through the open exhaust valve.

Figure 4E:
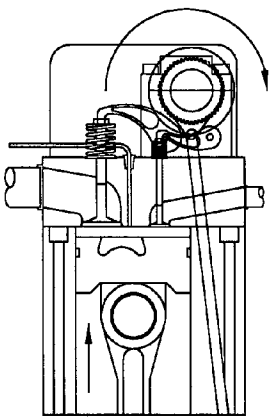
Figure 4D:
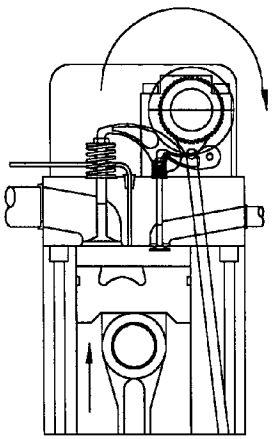
Figure 5A:
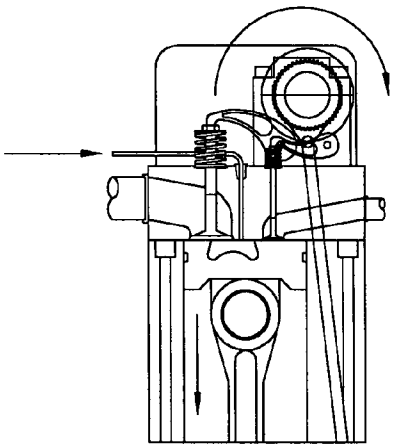
Figure 5B:
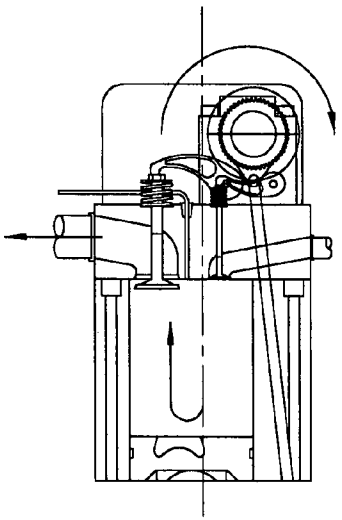
Figure 5C:
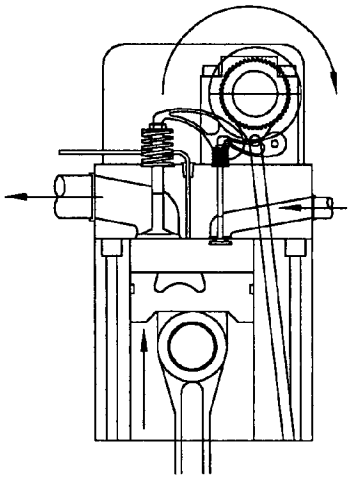
Figure 5D:
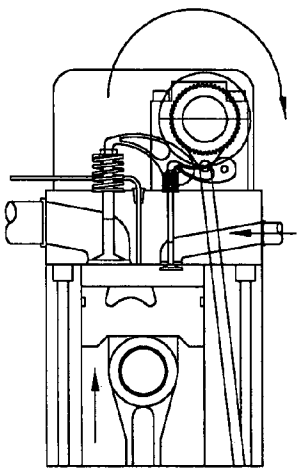
Figure 5E:
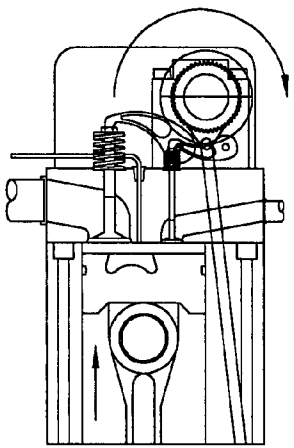

FIG. 4*d* shows the continued process. The exhaust valve is closed, but the scavenging valve is still open and feeding of pressurized air into the cylinder is continued till, as shown in FIG. 4*e*, the scavenging valve is also closed and the secondary compression of the air in the cylinder will happen, in the end of which phase the fuel injection will start the work phase again.

FIGS. 5*a* to 5*e* show the same sequence as described in FIGS. 4*a* to 4*e*. However, now there has been made a following change in the procedure. Now the exhaust valve is closed earlier than in FIGS. 4*a* to 4*e*, cf. FIGS. 4*c* and 5*c*. This means that part of the exhaust gases are left in the cylinder to mix with the incoming pressurized gas. This kind of internal re-circulation is favorable to the total process for example in order to lower the Nox output of the engine.

One of the disadvantages of a conventional two-stroke engine is that a part of the scavenging air shall be lost to the exhaust side. This can be prevented in the engine according to the present invention, by means of the timing of the valves. Also the "internal" re-circulation of the exhaust gas is possible, like described before. The exhaust valve is open about 180, typically 60 before the bottom dead centre –120 after the bottom dead centre.

For the opening time of the gas exchange valve or scavenging valve, meaning the time, during which the main part of the new mixture flows to the cylinder is 20–30 enough, close at the top dead centre of the piston, typically 120 after the bottom dead centre–30 before the top dead centre. This short opening time, close to the top dead centre of the piston, is enough, because the pressure of the coming gas is quite high, typically 3–15 bar, when its volume is small and the needed valves are small and light. The quite low rotating speed, typically 1000–4000 r/min, helps in this matter, because the inertia forces of the valve mechanism are proportional to the power of two of the speed of revolution. As a reference, some commercial motorcycles have engines, rotating 15000 18000 r/min, without any problems. After the gas exchange valve is closed, the piston continues its movement toward the top dead centre (the secondary compression), during which the fuel injection starts, and then the self ignition (ignition) and then combustion and expansion.

The fuel ignites or shall be ignited for example with a glow plug, injection of the assistant fuel, spark etc. A typical work cycle appears from the pictures 1 and 4 and 5. If a separate ignition fuel is used, it can be injected to the gas exchange duct, which is equipped with lamella, if needed, parallel with the flow. Also all the fuel can be injected only to gas exchange duct.

In the engine according to the invention, there can be a heat exchanger 33, 34, 35, in the gas flow, between the compressor-flush valve. Thus the temperature of the primary compressed gas, which is typically 3–15 bar, can be controlled for example from the exhaust gases.

One embodiment of a compressor can be seen in FIG. 1*a* wherein the piston head 5 is working also as a compressor piston. So gas is taken through a channel 30 to the volume below the piston head 5. When moving to the right (in FIG. 1*a*) the piston head 5 is compressing the air and the compressed air is fed out through the channel 32. Normally there is a reservoir 36 in which the pressurized air is collected and wherefrom it is used for injection through the channel 9.

The delivery volume of the compressor can be different from the stoke volume of the work pistons, so thus the expansion can be optimized.

In order to achieve a high mechanical efficiency, the expansion pistons and the compressor piston are on the same line; connected to each others, like shown before, when the final net power comes to the crank mechanism. Also a separate compressor, for example a screw compressor, is possible.

What is claimed is:

1. An Internal combustion engine, comprising at least one cylinder, at least one outlet valve and at least one scavenger valve for incoming new gas working with the 2-stroke principle whereby each cylinder produces power at every rotation of a crankshaft communicatively coupled to a piston associated with the cylinder, the engine further comprising means for feeding scavenging gas under pressure of at least 3 bar during approximately 60 to 5 degrees of crankshaft rotation before the top dead centre.

2. The engine according to claim 1, wherein the piston has first and second piston heads and a piston rod between the piston head, whereby the piston and the rod form a fixed unit.

3. The engine according to claim 2, wherein the first piston head is connected with two in line connecting rods to two crankshaft halves rotating in opposite directions.

4. The engine according to claim 3, wherein the crankshaft halves are connected with each other by first through fifth spur gears, whereby the third and fourth spur gears are fixed on an accessory shaft.

5. The engine according to claim 2, wherein the second piston head functions as a compressor piston for producing pressurized gas.

6. The engine according to claim 1, wherein the engine further comprises a cam construction for opening the exhaust valve before a bottom dead centre position and for closing the exhaust valve at approximately 120 degrees after the bottom dead centre position.

7. The engine according to claim 6, wherein the cam construction opens the scavenger valve at approximately 60 degrees before a top dead centre position and for closing the scavenger valve at or before approximately the top dead centre position.

8. An internal combustion engine comprising at least one cylinder, at piston associated with the cylinder, a crankshaft coupled to the piston, at least one outlet valve, and at least one scavenger valve for incoming new gas, the engine working with the 2-stroke principle whereby each cylinder produces power at every rotation of the crankshaft, the outlet valve being open from approximately 60 degrees before to 120 after a bottom dead center position and the scavenger valve being open from approximately 120 degrees after to 145 degrees after the bottom dead center position, whereby the outlet and scavenger valves are substantially not open at the same time, the engine further comprising means for feeding scavenging gas under high pressure of at least 3 bar while the scavenger valve is open.

9. A method for obtaining high efficiency in an internal combustion engine having at least one cylinder, at least one exhaust valve and at least one scavenger valve for the coming new gas working with the two-stroke principle, whereby each cylinder produces power at every rotation of a crankshaft communicatively connected to a piston associated with the cylinder, comprising the step that gas exchange in the cylinder is effected by leading high pressurized gas or gas/fuel mixture of at least 3 bar through the scavenger valve during a last quarter of rotation of the crankshaft before a top dead centre position.

10. A method according to claim 9, wherein gas exchange is effected during 80 to 0 degrees before the top dead centre.

11. A method according to claim 9, further comprising the step of controlling the temperature of the pressurized gas or gas/fuel mixture between the compressor and the flush valve by cooling or heating.

12. A method according to claim 9, further comprising the step of opening the exhaust valve before the bottom dead centre.

13. A method according to claim 12, wherein the exhaust valve is opened less than approximately 60 degrees before the bottom dead centre.

14. A method according to claim 9, further comprising the step of closing the exhaust valve before all of the exhaust gases have been driven out by the coming new scavenging gas.

15. A method according to claim 9, comprising the step of keeping the exhaust valve open approximately up to 120 degrees after the bottom dead centre.

16. A method according to claim 9, further comprising the step of opening the scavenging valve at approximately 120 degrees after the bottom dead centre.

17. A method according to claim 9, wherein the piston has two heads, and further comprising the step of using the second piston head as a compressor piston to develop pressurized gas.

18. A method according to claim 17, further comprising the step of differing the delivery volume of the compressor piston relative to the stroke volume of the first piston head, whereby expansion is optimized.

19. A method according to claim 9, further comprising the step of using a separate compressor to develop pressurized gas.

20. A method according to claim 9, whereby part or all of the fuel is injected into a channel of the scavenging gas.

21. An Internal combustion engine, comprising at least one cylinder, at least one outlet valve and at least one scavenger valve for incoming new gas working with the 2-stroke principle whereby each cylinder produces power at every rotation of a crankshaft communicatively coupled to a piston associated with the cylinder, the engine further comprising means for feeding scavenging gas under pressure of at least 3 bar during approximately 60 to 5 degrees of crankshaft rotation before the top dead centre, the engine further comprising a cam construction for opening the exhaust valve before a bottom dead centre position and for closing the exhaust valve at approximately 120 degrees after the bottom dead centre position.

22. A method for obtaining high efficiency in an internal combustion engine having at least one cylinder, at least one exhaust valve and at least one scavenger valve for the coming new gas working with the two-stroke principle, whereby each cylinder produces power at every rotation of a crankshaft communicatively connected to a piston associated with the cylinder, comprising the step that gas exchange in the cylinder is effected by leading high pressurized gas or gas/fuel mixture of at least 3 bar through the scavenger valve during a last quarter of rotation of the crankshaft before a top dead centre position, and further comprising the step of keeping the exhaust valve open approximately up to 120 degrees after the bottom dead centre.

23. A method for obtaining high efficiency in an internal combustion engine having at least one cylinder, at least one exhaust valve and at least one scavenger valve for the coming new gas working with the two-stroke principle, whereby each cylinder produces power at every rotation of a crankshaft communicatively connected to a piston associated with the cylinder, comprising the step that gas exchange in the cylinder is effected by leading high pressurized gas or gas/fuel mixture of at least 3 bar through the scavenger valve during a last quarter of rotation of the crankshaft before a top dead centre position, and further comprising the step of opening the scavenging valve at approximately 120 degrees after the bottom dead centre.

24. A method for obtaining high efficiency in an internal combustion engine having at least one cylinder, at least one exhaust valve and at least one scavenger valve for the coming new gas working with the two-stroke principle, whereby each cylinder produces power at every rotation of a crankshaft communicatively connected to a piston associated with the cylinder, comprising the step that gas exchange in the cylinder is effected by leading high pressurized gas or gas/fuel mixture of at least 3 bar through the scavenger valve during a last quarter of rotation of the crankshaft before a top dead centre position, and wherein the piston has two heads, and further comprising the step of using the second piston head as a compressor piston to develop pressurized gas, and further comprising the step of differing the delivery volume of the compressor piston relative to the stroke volume of the first piston head, whereby expansion is optimized.

* * * * *